United States Patent [19]

Sahl

[11] Patent Number: 4,465,002

[45] Date of Patent: Aug. 14, 1984

[54] BUTTON SEWING MACHINE

[76] Inventor: Johannes Sahl, Tannenweg 17, A-4501 Neuhofen/Krems, Austria

[21] Appl. No.: 330,318

[22] Filed: Dec. 14, 1981

[51] Int. Cl.[3] ..... D05B 3/14

[52] U.S. Cl. ..... 112/111; 112/114

[58] Field of Search ..... 112/111, 110, 114, 104, 112/70, 65

[56] References Cited

U.S. PATENT DOCUMENTS

| | | | |
|---|---|---|---|
| 2,131,387 | 9/1938 | Pikul | 112/111 |
| 3,381,638 | 5/1968 | Pope | 112/111 X |
| 3,858,536 | 1/1975 | Pope | 112/114 |

FOREIGN PATENT DOCUMENTS

| | | | |
|---|---|---|---|
| 2143878 | 4/1972 | Fed. Rep. of Germany | 112/111 |

*Primary Examiner*—H. Hampton Hunter
*Attorney, Agent, or Firm*—Kurt Kelman

[57] ABSTRACT

A button-sewing machine (1) comprises a needlebar frame (6), which is suspended like a pendulum and connected to a rocking linkage (8). A button-holding clamp (5) is tiltably mounted in a stand (4), which is carried by a base plate (3), which is mounted on the machine base (2) and longitudinally displaceable relative to said machine base and longitudinally reciprocable by an actuating head (9). The latter is operatively connected to the main shaft of the machine.

The machine can be used to perform several different working programs without an alteration of the machine. For this purpose the stand (4) is transversely movable relative to the baseplate (3) or the baseplate (3) is adapted to perform relative to the machine base (2) not only a longitudinal displacement but also a transverse angular movement. A coupling element (19) is provided, which is operable to selectively couple the actuating head (9) either to the baseplate (3) or to the rocking linkage (8) of the needlebar frame (6). Separate positioning drives (22, 23, 28) are provided for displacing the stand (4) or for imparting a transverse angular movement to the baseplate (3), for tilting the button-holding clamp (5) and for actuating the coupling element (19). These positioning drives are adapted to be energized and de-energized in response to the number of revolutions of the mainshaft of the machine or the number of stitches. Said numbers can be determined by control programs.

8 Claims, 2 Drawing Figures

BUTTON SEWING MACHINE

Figure 1:
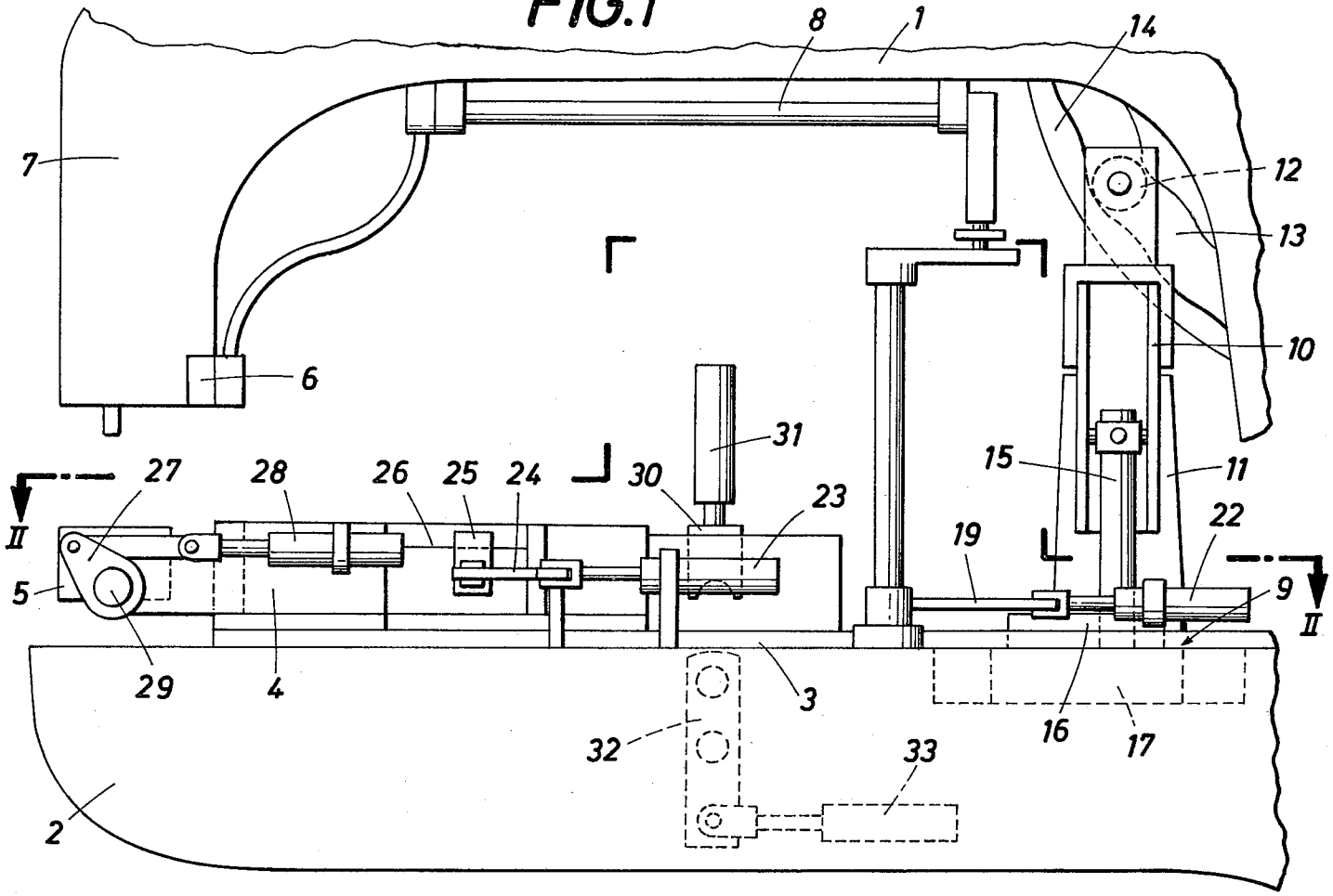

This invention relates to a button-sewing machine comprising a rocking linkage, which is connected to a needlebar frame that is suspended like a pendulum, a button-holding clamp, which is tiltably mounted in a stand, a baseplate, which is longitudinally slidably mounted on the machine base and carries the stand, and an actuating head, which serves to displace the baseplate and is reciprocable from the mainshaft of the machine by a driving mechanism.

Such so-called combined machines can be used to sew and shank a button in a continuous sequence of operations because when the button has been sewn the clamp holding the button can be tilted through 90° for the shanking operation. In the button-sewing operation, the rocking of the needle and the displacement of the baseplate are properly coordinated. The tilting of the clamp, the rocking of the needle and the displacement of the baseplate have previously been controlled and effected by means of a camwheel, which is driven from the mainshaft of the machine and has a plurality of cam grooves, in which roller pins or the like are moved, which by means of suitable bellcrank levers, rocking linkages, rocker levers or the like strictly mechanically transmit to the respective machine elements the motion which is predetermined by the shape of the grooves. Because the motions of the button-holding clamp, the needlebar frame and the baseplate are rigidly coupled to the roller pins received by the cam grooves of the camwheel, it is not possible to use one and the same machine or one and the same camwheel for sewing buttons of different kinds, e.g., buttons having two and four holes, or to change the sewing operation or the number of stitches. Moreover, only one and the same working program can be performed with one and the same machine and even the slightest change of the program will require a different machine or at least an alteration of the machine. Besides, the exchange of the camwheels is a very time-consuming and complicated operation and such camwheels with their various complicated cam grooves constitute a high investment.

For this reason it is an object of the invention to eliminate these disadvantages and to provide a button-sewing machine which is of the kind described hereinbefore and which is comparatively simple in structure and particularly permits without need for an alteration of the machine the performance of several different working programs, such as the sewing and shanking of buttons having two and four holes.

This object is accomplished according to the invention in that the stand is transversely displaceable relative to the baseplate or the baseplate is longitudinally displaceable and transversely angularly movable relative to the machine base, that a coupling element is provided, which is operable to couple the actuating head selectively to the baseplate or to the rocking linkage of the needlebar frame separate positioning drives are provided for displacing the stand or for imparting a transverse angular movement to the baseplate, for tilting the button-holding clamp, and for actuating the coupling element, and said positioning drives are energized and de-energized in a predetermined dependence on the performance of pre-selected numbers of revolutions of the mainshaft of the machine or of the number of stitches, which dependence is preselected by control programs or the like. Because a rocking of the needle, tilting of the clamp, a longitudinal displacement of the baseplate and, owing to the transverse displacement of the stand or the angular movement of the baseplate, a transverse displacement of the button-holding clamp can be performed and a separate drive is associated with each of these motions, all operations required to sew and shank a button can be performed without difficulty. The sequences of operation can be properly controlled in dependence on the number of stitches required for each operation so that any desired sequence of operations can be selected and can be set in that an appropriate control program is inserted with one manipulation. The actuating head is no longer used only to impart a longitudinal displacement to the baseplate but also to rock the needle. For this purpose the actuating head can be selectively coupled to the baseplate and to the corresponding rocking linkage so that only a small structural expenditure is required. The actuating head can readily be used to perform this dual function because the rocking of the needle is permissible only when the baseplate is not oscillating and vice versa. The manner in which the actuating head is driven is not significant. It may be driven in a conventional manner via a camwheel having a cam groove for a roller pin of a rocker lever, which is pivoted to the actuating head, or may be driven by a separate cam or crank mechanism, provided that the actuating head is reciprocated with an adjustable stroke and at a frequency having an appropriate ratio to the speed of the main shaft of the machine so that it is ensured that the displacement of the baseplate and the rocking of the needle will be properly matched with the stitching motion of the needle. To sew a button, the needle is moved up and down without rocking and the baseplate is longitudinally reciprocated to the extent determined by the actuating head. As a result, the holes of one and the other pair of holes of the button held by the clamp are positioned in alternation exactly under the needle. By the positioning drive for displacing the stand or for imparting an angular movement to the baseplate, the button-holding clamp has been laterally moved to the position which corresponds to that pair of holes of a button which is being sewn. For instance, during the sewing of a button having two holes the clamp will reciprocate in an intermediate position and in the sewing of a button having four holes the clamp will oscillate in one laterally offset position during the sewing through the holes of one pair and in the other laterally offset position during the sewing through the holes of the other pair. The position of the clamp will be changed when the desired number of stitches through the holes of one pair have been performed. When the sewing of the button has been completed, the actuating head is uncoupled from the baseplate and coupled to the rocking linkage so that the needle is subsequently rocked. At the same time the button-holding clamp is tilted through an angle of 90° and if it is not in its intermediate position, as is the case after the sewing of a button having four holes, the clamp is moved to and subsequently fixed in said intermediate position whereafter the needle is rocked to shank the button. This operation is also continued for a desired number of stitching cycles. Thereafter the button-holding clamp is tilted back to complete the sewing and shanking cycle. Such a sequence of operations can be controlled in various ways. A stitch counter or a pulse generator coupled to the means for driving the actuating head or similar means may be used in conjunction with a suitable controller to energize and deenergize the positioning drives in dependence on the number of stitches performed or of the revolutions of the main shaft of the machine in a sequence and interdependence determined by the program. There is no rigid coordination between the positioning drives and the number of revolutions of the mainshaft of the motor because the interconnected control system permits of a free selection of that coordination so that various sequences of operation can be performed in dependence on the control program.

The positioning drives may consist, e.g., of electromagnetic drives or hydraulic drives or the like and within the scope of the invention consist preferably of pneumatic cylinders. Such pneumatic cylinder can be operated in a simple and clean manner and can easily be controlled and actuated by suitable valves. Besides, they have an exactly defined stroke so that the desired positioning motion will depend only on the alternating supply of pressure fluid to the cylinders.

Because the button-holding clamp must be moved to an intermediate position for the sewing of a button having two holes and to two laterally offset positions for the sewing of a button having four holes, the positioning drive for displacing the stand or for angularly moving the baseplate comprises two pneumatic cylinders, the stroke positions of which define an intermediate position and two lateral positions of the stand or of the baseplate. In that case these two cylinders can simply be extended and retracted to move the button-holding clamp to the desired positions and the intermediate positions correspond to the extended position of one of the cylinders and the two lateral positions correspond to the retracted and extended positions of the other cylinder.

According to an advantageous development of the invention the baseplate is longitudinally displaceable and transversely angularly movable and its positioning drive cooperates with a transmitting linkage, which is pivoted to a slidable member, which is longitudinally slidable relative to the baseplate, and the actuating head comprises two sliders, which are rotatable relative to each other and one of which is longitudinally guided in the machine base whereas the other extends into a longitudinally extending cam slot in the baseplate. The slidable member and the two sliders ensure that the baseplate will be properly guided and permit the baseplate to perform not only a longitudinal displacement but also a transverse movement. To impart a transverse angular movement to the baseplate, the slidable member is moved by the positioning drive transeversely to the direction in which said slidable member is slidable. In that operation the slidable member rotates relative to the transmitting linkage in adaptation to the changing position of the baseplate. The sliders ensure that the actuating head will be guided in the machine base as exactly as desired and can perform its actuating function regardless of the position of the baseplate even at a time when the actuating head is not coupled to the baseplate.

In a particularly simple design, the coupling element carried by the actuating head consists of a pivoted arm and the associated positioning drive is adapted to releasably lock pivoted arm to a coupling female of the baseplate and to a coupling female of the rocking linkage. As a result, the continually reciprocated actuating head can be selectively coupled to the baseplate or to the rocking linkage as a result of a pivotal movement of the pivoted arm so that the desired operative connection can be established.

In a particularly desirable development of the invention, a fixing device is provided, which determines the position of the baseplate when the actuating head is coupled to the rocking linkage, and a support, which is displaceable in the longitudinal direction of the machine, is preferably associated with the fixing device. When the actuating head is coupled to the rocking linkage rather than to the baseplate, the baseplate can be freely displaced because it is not connected to a drive. In that case the fixing device will prevent an unintended movement of the baseplate; such movement might be imparted to the baseplate, e.g., by the transportation or manipulation of the garment which is to be provided with the button. If the fixing device is supported by a carriage or a pivoted abutment or the like so that the baseplate and the locking device can be intentionally moved in the longitudinal direction of the machine, the button can be shanked in a particularly beautiful manner because the longitudinal displacement will cause the button to be shanked in a uniform continuous manner throughout the length of its shank and the formation of the previously formed bulge on the shank will be avoided.

If the positioning drives of the machine consist of pneumatic cylinders, additional pneumatic cylinders are desirably used to actuate the fixing device and to displace the support so that the entire driving system is simple and can easily be overlocked, particularly if the button-holding clamp is also pneumatically actuated.

Figure 2:
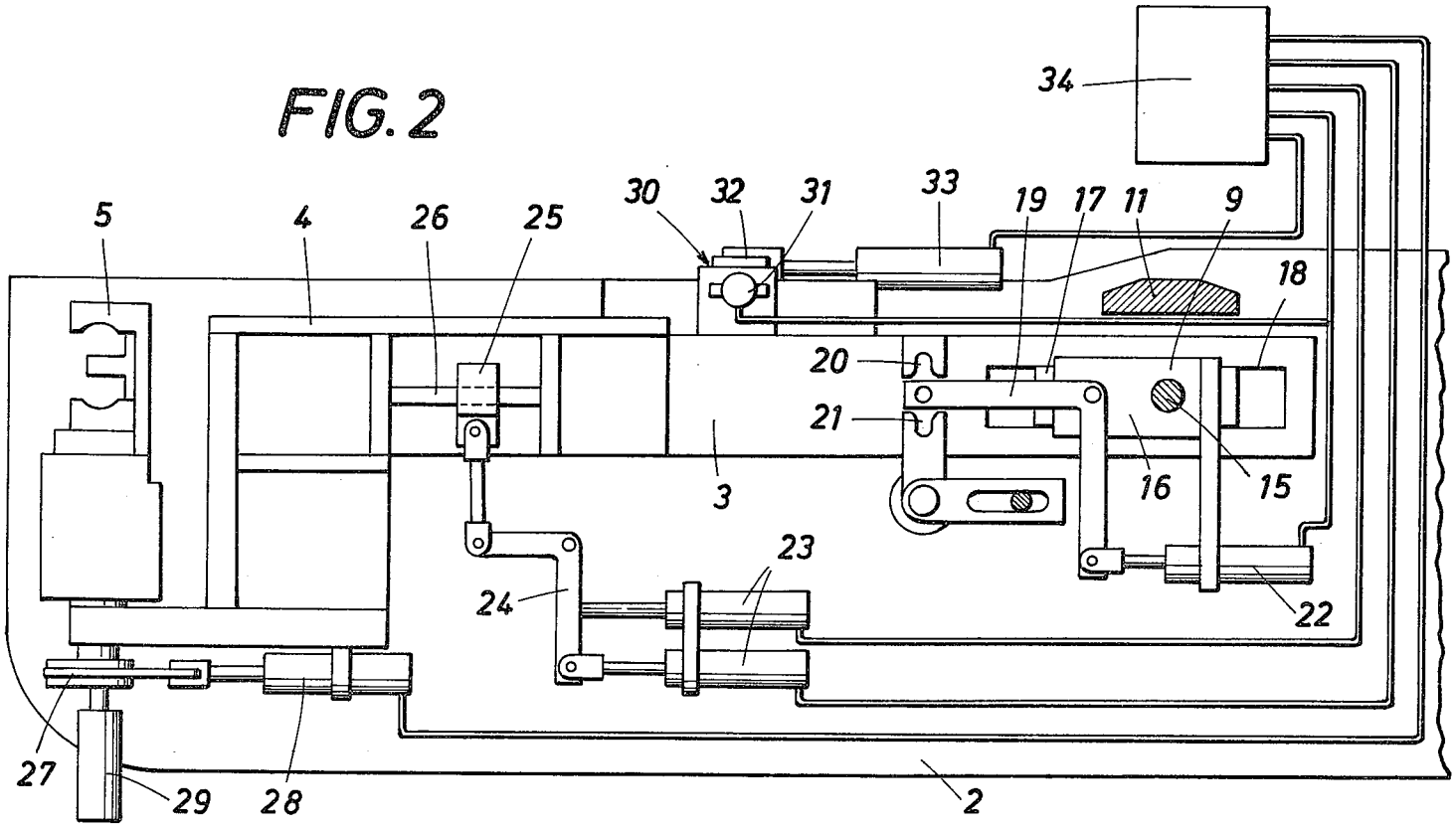

An illustrative embodiment of the invention is diagrammatically shown in the drawings, in which FIGS. 1 and 2 are respectively, a side elevation and a top plan view showing parts of a button-sewing machine according to the invention.

Button-sewing machine 1 carries on its base 2 a baseplate 3 which is longitudinally displaceable and transversely pivotal relative to the machine base 2. The baseplate 3 carries on its forward portion a stand 4 for a button-holding clamp 5 which is mounted to be tiltable about a transverse horizontal axis. A needlebar frame 6, which is not shown in detail, is suspended like a pendulum in the top 7 of the machine and is connected to a rocking linkage 8 for imparting a rocking or pendulum motion to frame 66 during the sewing operation.

The drive means for imparting a longitudinal displacement to the baseplate and for rocking the needle consists of an actuating head 9 which cooperates with a rocker lever 10. The rocker lever 10 is pivoted to a stand 11 which is fixed to the machine base 2. Roller pin 12 of rocker lever 10 engages cam groove 13 of a camwheel 14 which is driven from the mainshaft of the machine. The cam groove 13 has such a shape that the rocker lever 10 is reciprocated and thereby reciprocates the actuating head 9 in the longitudinal direction of the machine. The stroke of the actuating head can be changed by a vertical adjustment of the pivot connecting rocker lever 10 to the transmitting pin 15 of the actuating head. The actuating head 9 comprises an upper slider 16 and a lower slider 17. The lower slider 17 is longitudinally guided in the machine base 2 and ensures an exact movement of the actuating head 9. The upper slider 16 is fitted in a longitudinal slot 18 of the baseplate 3 and permits a longitudinal displacement and a transverse angular movement of the baseplate and guides the latter. A coupling element consisting of a pivoted arm 19 is mounted on the upper slider 16 and can be selectively moved to respective positions in which the arm is releasably locked in a coupling jaw 20 of the baseplate 3 and in a coupling jaw 21 of the actuating linkage 8. As a result, the actuating head 9 can be used to reciprocate either the baseplate 3 or the rocking linkage 8. The pivoted arm 19 is actuated by a pneumatic cylinder 22, whose piston rod can be retracted and extended to couple the actuating head 9 to the baseplate and to the rocking linkage.

For the sewing of buttons having two holes as well as buttons having four holes, the button-holding clamp 5 must be moved to positions in alignment with pairs of holes of such buttons, i.e., to an intermediate position for the sewing of a button having two holes and for shanking a button and to two lateral positions for the sewing of a button having four holes. In the embodiment shown by way of example this is made possible because baseplate 3 can perform not only a longitudinal displacement but also a transverse angular movement. That transverse angular movement is imparted to the baseplate by two additional pneumatic cylinders 23 which cooperate with a transmitting linkage 24. A slidable member 25 is longitudinally guided in the baseplate 3 and is movable transversely to its longitudinal track 26 by the transmitting linkage 24. In response to such a transverse movement of the slidable member 25, the baseplate 3 together with the slider 16 will perform an angular movement about the axis of rotation of the slider 16 and the slidable member 25 will adapt itself to that angular movement and together with the slider 16 will guide baseplate 3 in its longitudinal movement in any angular position. As it is sufficient to move the buttonholding clamp 5 by the baseplate 3 to an intermediate position and to two lateral positions, the positioning drive for imparting that angular movement may consist of the two simple pneumatic cylinders 23, one of which defines the two lateral positions and the other of which, having correspondingly shorter stroke, defines the intermediate position.

To enable the button-sewing machine to be used also to shank a button which has been sewn, the button-holding clamp 5 must be tiltable through an angle of 90°. For this purpose, the button-holding clamp 5 is rotatably mounted in the stand 4 and connected by a positioning lever 27 to a pneumatic cylinder 28 whose piston rod is adapted to be retracted and extended in order to tilt the button-holding clamp 5 through an angle of 90°. Another pneumatic cylinder 29 is operable to actuate, i.e., to open and close, the button-holding clamp.

A fixing device 30 is provided to prevent an unintended displacement of the baseplate 3 when the pivoted arm 19 has been disengaged from the coupling jaw 20 of the baseplate 3. Pneumatic cylinder 31 causes fixing device 30 lock baseplate 3 to a support so that the position of the baseplate will be fixed. The support consists of an abutment 32 which is pivoted in the machine base 2. A pneumatic cylinder 33 is adapted to impart an angular movement in the longitudinal direction of the machine to the abutment 32 so that the locking device together with the baseplate and the button-holding clamp can be displaced along the shank during the shanking operation and a neat shanking is thus ensured.

A controller 34 is provided for controlling the pneumatic cylinders 22, 23, 28, 31 and 33 in dependence on the number of stitches performed by the needles. These stitches are counted by stitch counters associated with the needlebar or by pulse counters associated with the main shaft of the machine or by similar means. The controller 34 coordinates the operations of the several pneumatic cylinders and ensures that the desired sequence of operations will be performed. Any desired sequence of operations can be initiated and will be automatically performed in response to the selection of a desired program for the control so that one and the same machine can be used without any alteration to perform all button-sewing operations which can be performed on a button-sewing machine. Depending on the kind of button, the baseplate will be held in an intermediate position during the sewing of a button having two holes and will be held in one and the other lateral position during the sewing of a button having four holes as the baseplate is reciprocated by the actuating head. As the actuating head is then coupled to the baseplate, no rocking motion will then be imparted to the needle and the needle will move through that hole of the button which is just under the needle. By means of the actuating head and the baseplate, the button gripped in the button-holding clamp is reciprocated in accordance with the pair of holes to be sewn. When the number of stitches required for the sewing of the button have been performed, the pneumatic cylinder 22 forces the pivoted arm 19 from the coupling jaw 20 to the coupling jaw 21 so that the actuating head 9 now imparts a rocking motion to the needle. At the same time, the pneumatic cylinder 28 has tilted the button-holding clamp 5 through 90° and the pneumatic cylinder 31 has locked the fixing device 30. If the button held by the button-holding clamp 5 has four holes, one of the pneumatic cylinders 23 will move the baseplate 3 to its intermediate position, which had already been assumed by the baseplate during the sewing of a button having two holes. Now the button is shanked while a rocking motion is imparted to the needle. During this shanking, an angular movement is imparted by the pneumatic cylinder 33 to the abutment 32 so that the fixing device 30 displaces the baseplate 3 and the button-holding clamp to an extent which corresponds to the length of the shank, which will now be uniformly wrapped throughout its length. This operation will also be continued for a predetermined number of stitches. Thereafter the button-holding clamp 5 will be tilted back and the machine will be reset to its initial position. All these operations are performed because controller 34 actuates the valves associated with the pneumatic cylinders in the programmed sequence. The sequence of operation of the button-sewing machine can be changed at any time simply by changing the program of the controller 34. For instance, a button having two holes or the like can be sewn immediately after a button having four holes. It is essential that the required movements are imparted to the button-holding clamp and the needle and that these movements can be controlled although they are not rigidly coupled to the drive of the machine. The specific design of the several elements is not significant in this connection.

I claim:

1. A button-sewing machine having a base and comprising (a) a base plate displaceable in the base in a first direction, (b) a button-holding clamp displaceable in a second direction transverse to the first direction and tiltable about an axis extending in the second direction, (c) respective drives for displacing and tilting the button-holding clamp, (d) a needlebar frame suspended above the button-holding clamp like a pendulum for rocking movement in the second direction, (e) actuating means for imparting the rocking movement to the needlebar frame, (f) a controller controlling the displacement of the base plate and the rocking movement of the needlebar frame, (g) releasable coupling means for selectively coupling the baseplate and the needlebar frame actuating means to the controller, and (h) another drive for operating the releasable coupling means to couple the baseplate and the needlebar frame actuating means selectively to the controller.

2. The button-sewing machine of claim 1, wherein the drives are pneumatic cylinders.

3. The button-sewing machine of claim 1, wherein the baseplate is pivotal in the second direction, the button-holding clamp is mounted on the baseplate for displacement in the second direction upon pivoting of the baseplate, the drive for displacing the button-holding clamp comprises two pneumatic cylinders linked to the baseplate for pivoting the baseplate, one of the cylinders having a stroke defining an intermediate position of the button-holding clamp and the other cylinder having strokes defining two positions laterally adjacent the intermediate position.

4. The button-sewing machine of claim 3, further comprising a force-transmitting linkage between the pneumatic cylinders and the baseplate, a connecting member mounted on the baseplate for slidable movement in the first direction relative to the baseplate, the linkage being pivoted to the connecting member, and an actuating head displaceably mounting the baseplate in the machine base, the actuating head including two sliders rotatable relative to each other, one of the sliders being longitudinally guided in the machine base and the other slider engaging a slot extending in the baseplate in the first direction.

5. The button-sewing machine of claim 1, wherein the releasable coupling means comprises a first coupling jaw in the baseplate, a second coupling jaw in the needlebar frame actuating means, an arm pivotal to engage a selected one of the coupling jaws for releasably locking the arm to the selected coupling jaw, and the other drive pivoting the arm.

6. The button-sewing machine of claim 1, further comprising a device movable by the controller into a locking position for fixing the baseplate in a predetermined position when the other drive operates the coupling means to couple the needlebar frame actuating means to the controller.

7. The button-sewing machine of claim 6, further comprising a support for the fixing device, the fixing device support being displaceable in the first direction.

8. The button-sewing machine of claim 7, further pneumatic cylinders for moving the fixing device into the locking position and for displacing the fixing device support.

* * * * *